US012677966B2

(12) United States Patent
Rawat

(10) Patent No.: US 12,677,966 B2
(45) Date of Patent: Jul. 14, 2026

(54) REVERSIBLE PILLOW

(71) Applicant: Standard Fiber, LLC, Burlingame, CA (US)

(72) Inventor: Pankaj Rawat, Millburn, NJ (US)

(73) Assignee: Standard Fiber, LLC, NV (US)

( * ) Notice: Subject to any disclaimer, the term of this patent is extended or adjusted under 35 U.S.C. 154(b) by 0 days.

(21) Appl. No.: 17/526,444

(22) Filed: Nov. 15, 2021

(65) Prior Publication Data

US 2023/0148770 A1 May 18, 2023

(51) Int. Cl.
*A47G 9/10* (2006.01)

(52) U.S. Cl.
CPC ..... *A47G 9/10* (2013.01); *A47G 9/1009* (2013.01); *A47G 9/1027* (2013.01); *A47G 9/1036* (2013.01); *A47G 9/1045* (2013.01); *A47G 9/1054* (2013.01); *A47G 9/1063* (2013.01); *A47G 9/1072* (2013.01); *A47G 9/1081* (2013.01)

(58) Field of Classification Search
CPC ..... A47G 9/10; A47G 9/1045; A47G 2009/1018; A47G 9/1036; A47G 9/1009; A47G 9/1081; A47G 9/1054; A47G 9/1063; A47G 9/1072; A47G 9/1027; A47G 9/0253; A47G 2009/003; A47G 9/109; A47G 9/04; A47G 2009/001; A47C 7/383; A47C 20/027; A47C 20/02; A47C 20/021; A47C 20/023; A47C 20/025; A47C 7/386
USPC ..... 5/636, 640, 645, 637, 639, 657
See application file for complete search history.

(56) References Cited

U.S. PATENT DOCUMENTS 1,447,288 A * 3/1923 Emmerich ..... A47G 9/10 5/645
6,988,286 B2 * 1/2006 Schecter ..... A47G 9/10 5/645
D898,423 S * 10/2020 Liu ..... D6/601
2003/0226205 A1 * 12/2003 Fishman ..... A47G 9/086 5/413 R
2006/0174411 A1 * 8/2006 Merlini ..... A47G 9/1045 5/490
2016/0166092 A1 * 6/2016 Alletto, Jr. ..... A47G 9/10 5/636
2017/0020312 A1 * 1/2017 Davis ..... A47G 9/10
2018/0028001 A1 * 2/2018 Wilmarth ..... A47C 20/027
(Continued)

FOREIGN PATENT DOCUMENTS

EP 2036460 A1 * 3/2009 ..... A47G 9/10

*Primary Examiner* — Justin C Mikowski
*Assistant Examiner* — Deborah Talitha Gedeon
(74) *Attorney, Agent, or Firm* — Dax D. Anderson; Kirton McConkie

(57) ABSTRACT

A reversible pillow includes first and second panels each having first and second surfaces. The panels each have a plurality of edges. The first and second are panels joined along an edge to define an axis of rotation of the panels relative to one another. A releasable fastener extends along the non-joined edges. The releasable fastener is for fastening the first and second panels to one another. The panels are rotatable about the axis in a first direction such that the first and second panel first surfaces are on an outside of the pillow, and are rotatable about the axis in a second opposite direction such that the first and second panel second surfaces are on the outside of the pillow. The first and second panel first and second surfaces can be fabricated from different materials.

16 Claims, 2 Drawing Sheets

(56) References Cited

U.S. PATENT DOCUMENTS

2018/0344060 A1* 12/2018 Lee ..... A47G 9/10
2020/0288891 A1* 9/2020 Mack ..... A47G 9/10

* cited by examiner 10
24
16
26
26
20

15
A28/30
20
16
36
14
12
36

24
22
26
18
26

REVERSIBLE PILLOW

BACKGROUND

The following description relates to a pillow, and more particularly to a reversible and adjustable pillow.

A pillow typically includes an outer layer or cover defining an interior volume configured to have a pillow insert received therein. The pillow insert is typically a self-contained unit having, for example, a woven, knit or non-woven cover having a fill such as polyester, foam, fiber, down, feathers and combinations thereof in the interior volume. The pillow is configured to provide support, cushioning and/or comfort to a user resting on the pillow. Some pillow covers are configured to allow inserting or removing some of the fill to allow for a more or less full pillow.

Pillow covers are typically fabricated from a single material. For example, as noted above, pillow covers may be fabricated from a woven, knit or non-woven material. Cotton or cotton blends and polyester are the most common material for pillow covers. Typically, the cover cannot be removed as it contains the fill. As such, the choices of pillow cover can be quite limited.

Accordingly, it is desirable to provide a pillow that provides for different material surfaces. Desirably, such a pillow further provides for adding fill to increase the depth or height of the pillow.

SUMMARY

According to one aspect a reversible pillow includes a first panel having a first surface and a second surface opposite the first surface, a second panel having a first surface and a second surface. The first and second panels having a plurality of edges. The panels are joined to one another along an edge of the first panel and an edge of the second panel to define an axis of rotation of the panels relative to one another.

A releasable fastener extends along at least a portion of the others of the first and second panel edges. The releasable fastener is configured for fastening the first and second panels to one another.

The panels are rotatable about the axis in a first direction such that the first and second panel first surfaces are on an outside of the pillow, and are rotatable about the axis in a second direction opposite the first direction such that the first and second panel second surfaces are on the outside of the pillow.

In embodiments, when the first and second panel first surfaces are on the outside of the pillow it defines a first closed state, and when the first and second panel second surfaces are on the outside of the pillow it defines a second closed state.

The releasable fastener can be fastened when the pillow is in the first closed state and it can be fastened when the pillow is in the second closed state. In embodiments, the releasable fastener is a zipper.

The first panel first and second surfaces and the second panel first and second surfaces can be formed from different materials. The materials can be, for example, cotton, a cotton blend, fleece material, satin or a satin like material, flannel and combinations thereof.

In embodiments, the first and/or second panels each define an interior volume and a fill is disposed in the interior volumes. Examples of fill include polyester, foam, fiber, feathers, down and combinations thereof.

The panels can further include a gusset panel between and joining the panels' first and second surfaces. Some or all of the gusset panels can be formed from a mesh material to allow the panels to breath.

In embodiments, the inserts can be disposed in the pillow, between the panels when the pillow is in the first or second closed state.

In another aspect, a reversible pillow includes first and second panels, each having a first portion of an edge, the first portions of the edges define an axis of rotation, and a zipper having mating portions. A first portion of the zipper is on the first panel edge other than the first portion and the zipper second mating portion is on the second panel edge other than the first portion. The panels are rotatable about the axis in a first direction and the zipper portions are mated (closed) to define a first closed state of the pillow, and the first and second panels are rotatable about the axis in a second direction and the zipper is closed to define a second closed.

The panels can include first and second surfaces operably joined to one another to define a first and second panel interior volumes. The interior volumes can include fill, such as polyester, foam, fiber, feathers, down and combinations thereof.

In embodiments, the first and second panel first and second surfaces can be formed from different materials. Examples of surface materials include cotton, a cotton blend, fleece, a satin or satin like material, flannel and combinations thereof.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figures 1, 2, 3, 4:
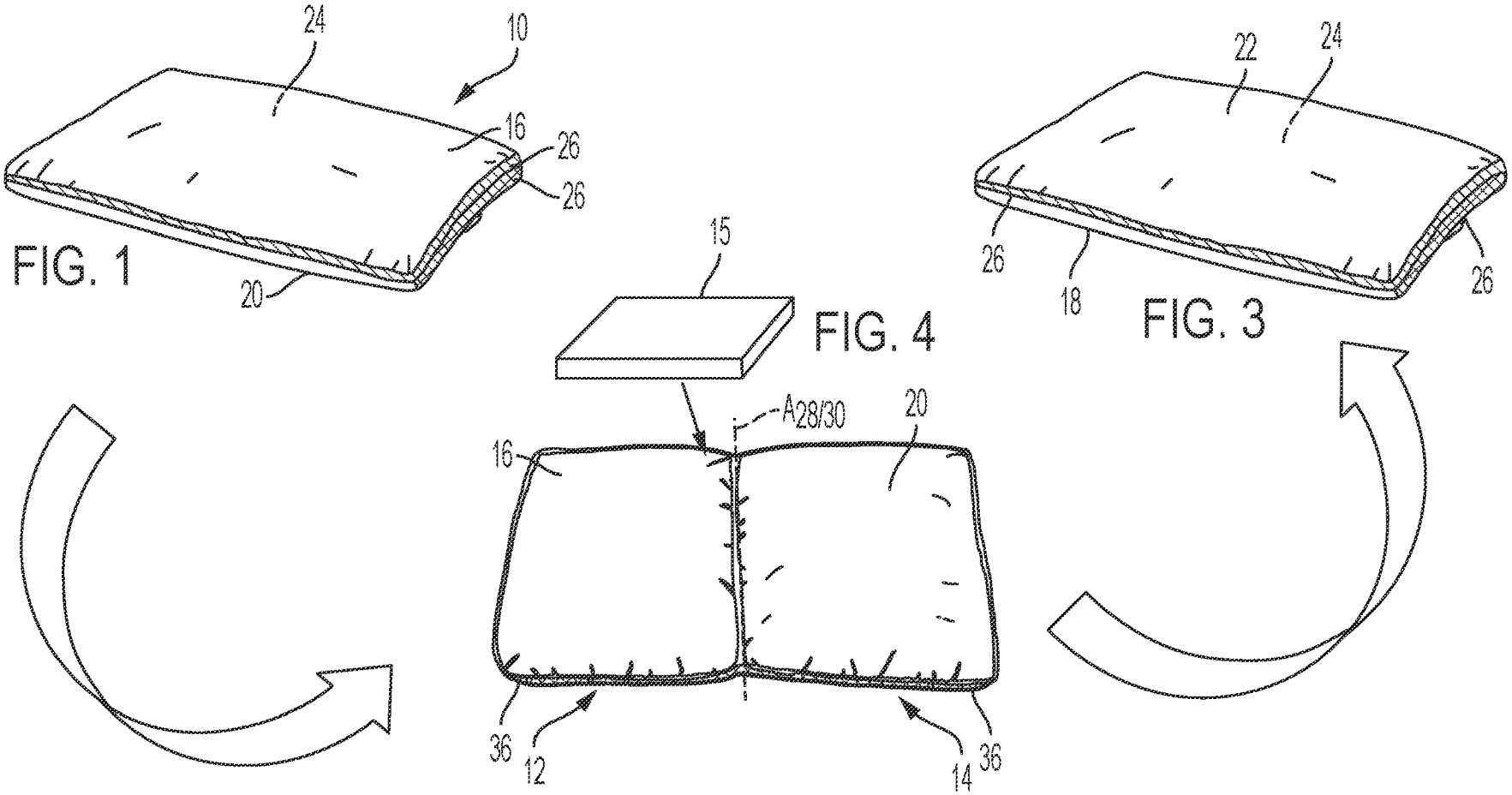
FIG. 1 is perspective illustration of an embodiment of a reversible pillow described herein showing a top surface of the pillow in a first closed state.
FIG. 2 illustrates the pillow in an open state.
FIG. 3 is a perspective illustration of the pillow showing a top surface of the pillow in a reversed or second closed state.
FIG. 4 illustrates an optional fill for the pillow.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

FIG. 1 illustrates a reversible pillow according to embodiments described herein. The pillow 10 includes first and second panels 12, 14, each panel 12, 14, having first and second surfaces, in which the first panel first surface is indicated at 16, the first panel second surface is indicated at 18, the second panel first surface is indicated at 20, and the second panel second surface is indicated at 22. In an embodiment, each panel 12, 14 is sealed and includes a fill (indicated at 24), such as polyester, foam, fiber, feathers, down and combinations thereof. Other fill 24 materials will be recognized by those skilled in the art. The panels 12, 14 can include the same fill or the panels 12, 14 can include different fill from one another.

In an embodiment, the first and second surfaces of each panel, that is surfaces 16 and 18 of the first panel 12 and surfaces 20 and 22 of the second panel 14 are joined directly to each other. In another embodiment, a gusset panel 26, such as a mesh panel is positioned between at least portions of the first and second panels 12, 14 and joins the first and second surfaces 16/18 and 20/22 to each other. In an embodiment, the mesh gusset panel 26 is positioned between portions of the first and second surfaces 16/18 and 20/22 of each panel 12, 14. In embodiments, the mesh gusset panel 26 is positioned fully between the first and second surfaces 16/18 and 20/22 of each panel 12, 14. The mesh panel 26 facilitates air circulation into and out of the interiors of each panel 12, 14. It will be understood that some or all of the gusset panels 26 can be formed from a mesh material.

A side 28 of the first panel 12 is fixedly joined to a corresponding side 30 of the second panel 30, so that the pillow opens in a book-like manner, rotating about an axis $A_{28/30}$. But unlike a book, the panels can be rotated in both directions. In an embodiment, the sides 28, 30 joined to one another are on the long sides of the pillow 10 as shown. Alternately, the joined sides can be on the short sides of the pillow 10. The remaining three sides 32 (the first panel 12 sides) and 34 (the second panel 14 sides) are not a fixedly joined to one another. Rather, the sides 32, 34 are removably fastened (e.g., joinable) to one another by, for example, the illustrated zipper 36. Fastening the panels 12, 14 to one another forms a closed state of the pillow. Other fastening elements are anticipated, such as snaps, buttons and the like, all of which fastening elements are within the scope and spirit of the present disclosure.

Referring to FIG. 3, an optional insert 15 can be positioned between the first and second panels 12, 14 to increase the loft or height of the pillow 10. The insert 15 can, similar to the fill, be fabricated from polyester, foam, fiber, feathers, down and combinations thereof. Other insert 15 materials will be recognized by those skilled in the art.

Figure 5:
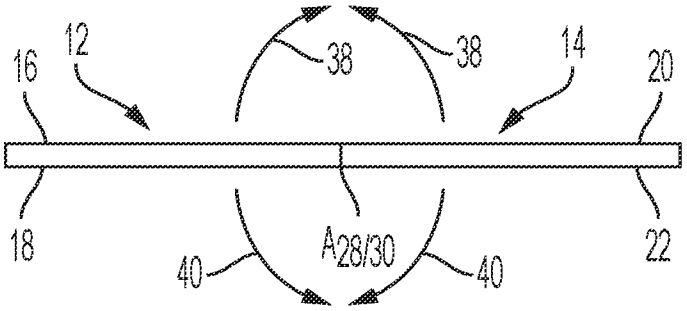
FIG. 5 is a schematic illustration of the pillow in an open state.

In a current embodiment at least some of the surfaces 16, 18, 20, 22 are formed from materials different from others of the surfaces. And, some of the surfaces can, of course be formed from the same material. For example, surface 16 can be a cotton or cotton blend material, while surface 18 is a fleece material, surface 20 a satin or satin like material and surface 24 a flannel material. Other fill surface 16, 18, 20,22 materials will be recognized by those skilled in the art. As noted above, the pillow 10 opens in a book-like manner. However, unlike a book, the panels 12, 14 can be rotated in both directions around the axis $A_{28/30}$ as illustrated by the arrows 38 and 40 in FIG. 5.

Figure 7:
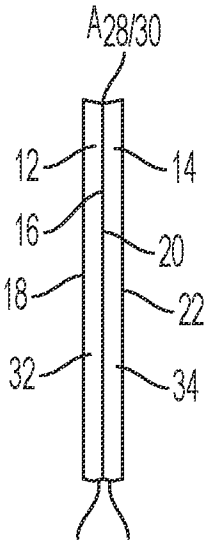
FIG. 7 is a schematic illustration of the pillow in the second closed state.
Figure 6:
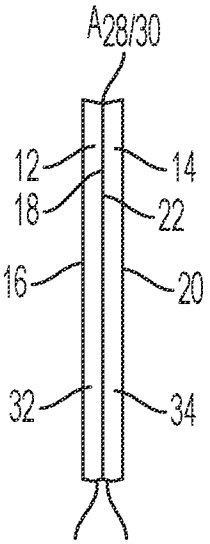
FIG. 6 is a schematic illustration of the pillow in the first closed state.

That is, the pillow 10 can be closed with the first panel second surface 18 and second panel second surface 22 facing each other in a first closed state (FIG. 6) such that surfaces 16 and 20 are on the outside of the pillow. Alternately, the pillow can be closed with the first panel first surface 16 and second panel first surface 20 facing each other in a second closed state (FIG. 7) such that surfaces 18 and 22 are on the outside of the pillow 10. In this manner, any of the surfaces 16, 18, 20, 22 can be chosen by a user.

Accordingly, in the embodiments above, a pillow 10 has multiple surfaces 16, 18, 20, 22 that can be different from one another. Further, the loft of such a pillow 10 is easily changed by the insertion or removal of an insert 15 between the panels 12, 14. Air flow into and out of the pillow 10 can be effected by the use of a breathable gusset panel 26, such as a mesh gusset panel joining all or portions of surfaces 16 and 18 of the first panel 12 and/or surfaces 20 and 22 of the second panel 14. Some or all of the gusset panels 26 can be formed from a mesh material.

The directional references of top, bottom, upper, lower and side are provided for reference only and are not intended to limit the disclosure in any way.

All patents referred to herein, are incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover by the appended claims all such modifications as fall within the scope of the claims.

The invention claimed is:

1. A reversible pillow comprising:

a first panel having a first surface and a second surface opposite the first surface, wherein the first panel defines a first panel interior volume having a first fill disposed therein;

a second panel having a first surface and a second surface, wherein the second panel defines a second panel interior volume having a second fill disposed therein, the first panel having first, second, third and fourth edges and the second panel having first, second, third and fourth edges corresponding to the first panel first, second, third and fourth edges, a connecting gusset panel having a first edge joined to a first edge of the first panel and a second edge joined to a first edge of the second panel, the connecting gusset panel thereby defining a hinge region about which the first and second panels are rotatable relative to one another;

a zipper extending along the second, third and fourth edges of the first and second panels, wherein the zipper does not extend along the first edge, the zipper configured for fastening the first and second panels to one another along the second, third and fourth edges;

a removable insert distinct from the first fill and the second fill;

wherein the first and second panels are rotatable about the hinge region in a first direction such that the first panel first surface and the second panel first surface are on an outside of the pillow, and are rotatable about the hinge region in a second direction opposite the first direction such that the first panel second surface and the second panel second surface are on the outside of the pillow;

wherein, when the first and second panels are rotated in the first direction and fastened by the zipper, the first panel second surface and the second panel second surface, together with the connecting gusset panel, define a central cavity therebetween;

and wherein the removable insert is enclosed within said central cavity by the first panel, the second panel, the connecting gusset panel, and the zipper.

2. The reversible pillow of claim 1, wherein the first fill is different from the second fill.

3. The reversible pillow of claim 2, wherein the fill in the first panel interior volume is one or more of polyester, foam, fiber, feathers, down and combinations thereof, and wherein the fill in the second panel interior volume is one or more of polyester, foam, fiber, feathers, down and combinations thereof.

4. The reversible pillow of claim 1, further including a first panel gusset panel between and joining at least portions of the first panel first surface and the first panel second surface.

5. The reversible pillow of claim 1, wherein the connecting gusset panel comprises a mesh material configured to facilitate air circulation into and out of the central cavity.

6. The reversible pillow of claim 1, wherein the removable insert comprises a foam material distinct from the first fill and the second fill.

7. The reversible pillow of claim 1, wherein the removable insert is configured to increase a loft of the reversible pillow.

8. The reversible pillow of claim 1, wherein the first panel first surface, the first panel second surface, the second panel first surface, and the second panel second surface are each formed from a material different from one another.

9. The reversible pillow of claim 8, wherein the different materials comprise a cotton material, a cotton blend material, a fleece material, a satin or satin-like material, a flannel material, and combinations thereof.

10. A reversible pillow comprising:

a first panel having first, second, third, and fourth edge portions and a second panel having first, second, third, and fourth edge portions a connecting gusset panel having a first edge joined to the first edge portion of the first panel and a second edge joined to the first edge portion of the second panel, the connecting gusset panel thereby defining a hinge region about which the first and second panels are rotatable relative to one another;

one or more closure members on each of the first panel second, third, and fourth edge portions and one or more closure members on each of the second panel second, third, and fourth edge portions, wherein the closure members on the first panel second, third, and fourth edge portions are configured to engage with the closure members on the second panel second, third, and fourth edge portions, respectively;

wherein the first and second panels are rotatable about the hinge region in a first direction to bring the first panel first surface and the second panel first surface into facing relationship, and wherein the closure members are engageable to maintain the pillow in a first closed state defining a first enclosed interior space; and wherein the first and second panels are rotatable about the hinge region in a second direction opposite the first direction to bring the first panel second surface and the second panel second surface into facing relationship, and wherein the closure members are engageable to maintain the pillow in a second closed state defining a second enclosed interior space.

11. The reversible pillow of claim 10, wherein the first panel includes first and second surfaces operably joined to one another to define a first panel interior volume, and wherein the second panel includes first and second surfaces operably joined to one another to define a second panel interior volume.

12. The reversible pillow of claim 11, wherein the first panel interior volume includes a first fill, the first fill being one or more of polyester, foam, fiber, feathers, down and combinations thereof, and wherein the second panel interior volume includes a second fill, the second fill being one or more of polyester, foam, fiber, feathers, down and combinations thereof, and being different from the first fill.

13. The reversible pillow of claim 11, wherein one or more of the first panel first and second surfaces and the second panel first and second surfaces are formed from different materials.

14. The reversible pillow of claim 13, wherein the different materials comprise a cotton material, a cotton blend material, a fleece material, a satin or satin-like material, a flannel material, and combinations thereof.

15. The reversible pillow of claim 10, further comprising a removable insert configured to be enclosed within the first enclosed interior space when the reversible pillow is in the first closed state.

16. The reversible pillow of claim 10, wherein the connecting gusset panel comprises a mesh material configured to facilitate air circulation.

* * * * *